US012472400B2

(12) United States Patent
Nesbitt

(10) Patent No.: US 12,472,400 B2
(45) Date of Patent: Nov. 18, 2025

(54) EXERCISE DEVICE

(71) Applicant: Matthew Nesbitt, Okeechobee, FL (US)

(72) Inventor: Matthew Nesbitt, Okeechobee, FL (US)

( * ) Notice: Subject to any disclaimer, the term of this patent is extended or adjusted under 35 U.S.C. 154(b) by 66 days.

(21) Appl. No.: 18/430,883

(22) Filed: Feb. 2, 2024

(65) Prior Publication Data

US 2025/0249306 A1 Aug. 7, 2025

(51) Int. Cl.

| | |
|---|---|
| ***A63B 21/00*** | (2006.01) |
| ***A63B 21/055*** | (2006.01) |
| ***A63B 23/02*** | (2006.01) |
| ***A63B 23/04*** | (2006.01) |

(52) U.S. Cl.

CPC ..... *A63B 21/4035* (2015.10); *A63B 21/0552* (2013.01); *A63B 21/4034* (2015.10); *A63B 23/0211* (2013.01); *A63B 23/0488* (2013.01)

(58) Field of Classification Search

CPC ..... A63B 21/00043; A63B 21/00061; A63B 21/0428; A63B 21/055; A63B 21/0552; A63B 21/0557; A63B 21/4033; A63B 21/4034; A63B 21/4035; A63B 23/0211; A63B 23/0355; A63B 23/0488; A63B 23/12; A63B 69/0057; A63B 69/0059; A63B 69/0062; A63B 23/1236; A63B 2208/0295

See application file for complete search history.

(56) References Cited

U.S. PATENT DOCUMENTS

| | | | | |
|---|---|---|---|---|
| 1,698,831 | A * | 1/1929 | Weimar | A63B 21/00043 482/126 |
| 3,664,667 | A * | 5/1972 | McCarthy | A63B 22/20 482/131 |
| 4,733,861 | A * | 3/1988 | Plunkett, III | A63B 21/00185 482/125 |
| 4,768,778 | A * | 9/1988 | Thomas, Jr. | A63B 23/14 482/141 |
| D348,707 | S * | 7/1994 | Cordell | D21/692 |
| 2005/0085355 | A1* | 4/2005 | Berard | A63B 21/0552 482/126 |

(Continued)

FOREIGN PATENT DOCUMENTS

| | | | | |
|---|---|---|---|---|
| CN | 109331423 B | * | 8/2023 | A63B 23/1236 |
| DE | 20103906 U1 | * | 5/2001 | A63B 23/0211 |

(Continued)

*Primary Examiner* — Gary D Urbiel Goldner

(74) *Attorney, Agent, or Firm* — The Rapacke Law Group, P.A.

(57) ABSTRACT

An exercise device includes a first handle assembly and a second handle assembly, the first handle assembly including a first handle and the second handle assembly including a second handle. A first cylinder is retained within an inner diameter of the first handle and a second cylinder is retained within the inner diameter of the second cylinder. A first elastic band is attached to top portions of the first cylinder and the second cylinder, and a second elastic band attached to bottom portions of the first cylinder and the second cylinder. Each of the first and second elastic bands provides resistance when spreading the first handle assembly and the second handle assembly apart.

18 Claims, 6 Drawing Sheets

(56) References Cited

U.S. PATENT DOCUMENTS

| | | | | |
|---|---|---|---|---|
| 2005/0085356 | A1* | 4/2005 | Berard | A63B 21/0552<br>482/126 |
| 2013/0123081 | A1* | 5/2013 | Boland | A63B 21/023<br>482/141 |
| 2014/0187395 | A1* | 7/2014 | Blahnik | A63B 23/1236<br>482/141 |
| 2015/0335935 | A1* | 11/2015 | Peralo | A63B 21/012<br>482/93 |

FOREIGN PATENT DOCUMENTS

| | | | | |
|---|---|---|---|---|
| KR | 102159758 | B1 * | 9/2020 | A63B 21/0557 |
| KR | 20210012468 | A * | 2/2021 | A63B 23/1236 |

* cited by examiner

EXERCISE DEVICE

TECHNICAL FIELD

The embodiments disclosed herein generally relate to exercise devices.

BACKGROUND

The benefits of exercise and physical activity are well-known as being an important component to physical health, longevity, and general well-being. Performing a broad spectrum of exercised which target various parts of the body is thought to be most-efficient for overall strength. Many exercise devices exist which target specific muscle groups, each having various exercised capable of being performed using the particular device.

SUMMARY OF THE INVENTION

This summary is provided to introduce a variety of concepts in a simplified form that is further disclosed in the detailed description of the embodiments. This summary is not intended for determining the scope of the claimed subject matter.

The embodiments provided herein relate to an exercise device, including a first handle assembly and a second handle assembly, the first handle assembly including a first handle and the second handle assembly including a second handle. A first cylinder is retained within an inner diameter of the first handle and a second cylinder is retained within the inner diameter of the second cylinder. A first elastic band is attached to top portions of the first cylinder and the second cylinder, and a second elastic band attached to bottom portions of the first cylinder and the second cylinder. A wheel is provided on the bottom of each handle assembly to allow the device to roll on a surface. Each of the first and second elastic bands provide resistance when spreading the first handle assembly and the second handle assembly apart.

The exercise device can be used to stimulate the upper body, abdominals, legs, hip muscles, etc. Some exercises may target the arm muscles, shoulder muscles, back muscles, and core muscles (abdominal muscles).

In one aspect, the first handle and the second handle each include a grip.

In one aspect, each grip includes a plurality of ridges to aid in grasping the grip.

In one aspect, each ridge is separated by a recessed portion to accept the user's fingers.

In one aspect, each of the first and second elastic bands enter the cylinder through a first and second opening provided on each of the top portion and the bottom portion of the first and second cylinders.

In one aspect, the grip is constructed of rubber, plastic, and/or may be provided with an abrasive coating.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
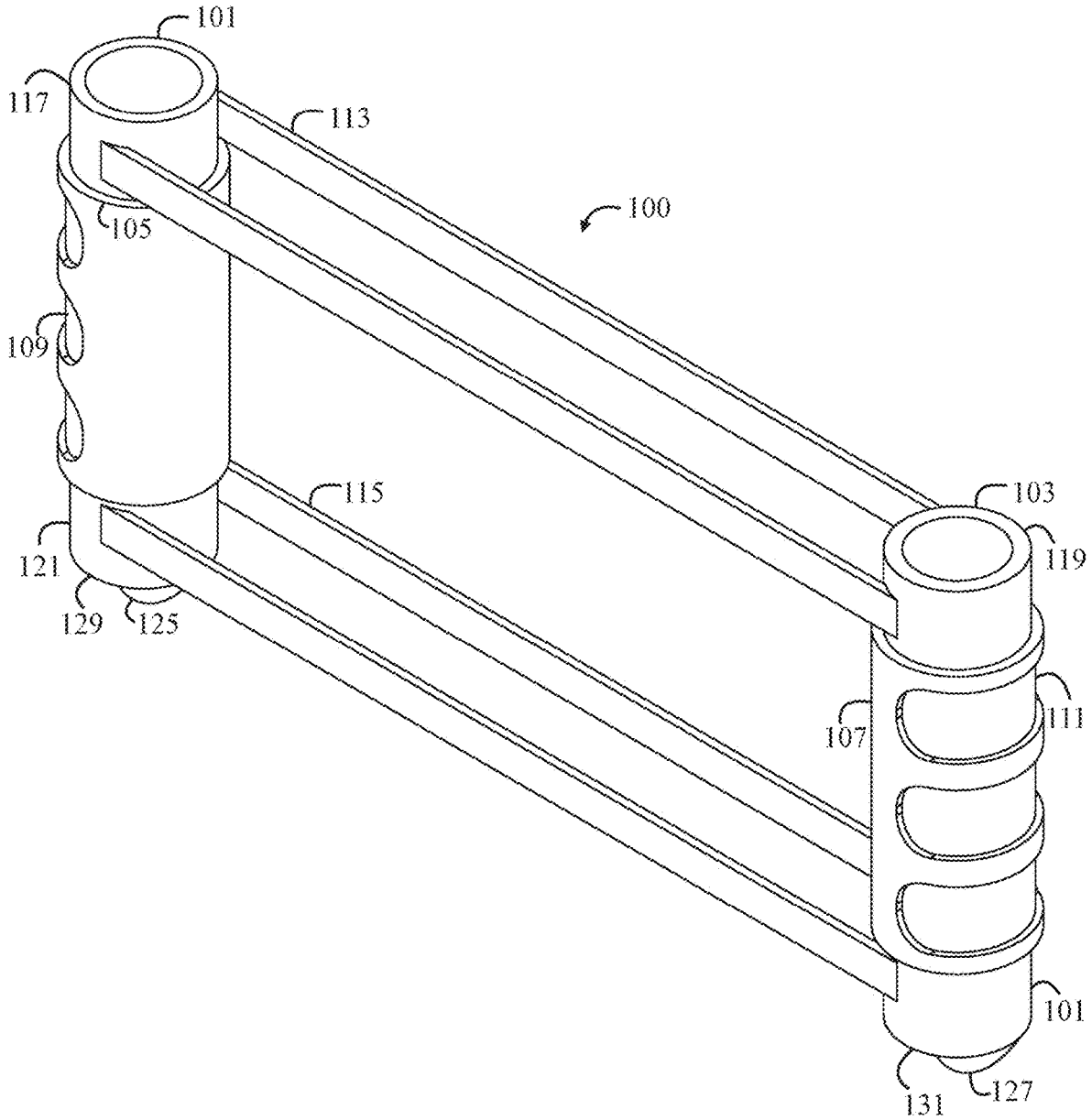
FIG. 1 illustrates a perspective view of the exercise device, according to some embodiments.

The specific details of the single embodiment or variety of embodiments described herein are set forth in this application. Any specific details of the embodiments described herein are used for demonstration purposes only, and no unnecessary limitation(s) or inference(s) are to be understood or imputed therefrom.

Before describing in detail exemplary embodiments, it is noted that the embodiments reside primarily in combinations of components related to particular devices and systems. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided herein relate to an exercise device which can be used to perform a variety of exercised to stimulate various muscle groups, prevent injury, and promote general well-being. The exercise device includes two handles having two elastic bands providing biased tension between each handle. A wheel is positioned at the bottom of each handle.

In some examples, the exercise device can be used to stimulate the upper body, abdominals, legs, hip muscles, among others. Some exercised may target the arm muscles, shoulders muscles, back muscles, and core muscles (abdominal muscles).

In some examples, the wheels allow for the exercise device to roll on a ground surface or other surface to perform abdominal roll-outs or similar exercises.

In some examples, the user may position there feet to contact the handles, performing an exercise where the feet are used to spread the handles apart, thus exercising the leg muscles and hip muscles.

In some embodiments, the handles may be moved in nearly any direction to cause the elastic bands to stretch apart, thus causing tension.

Figure 2:
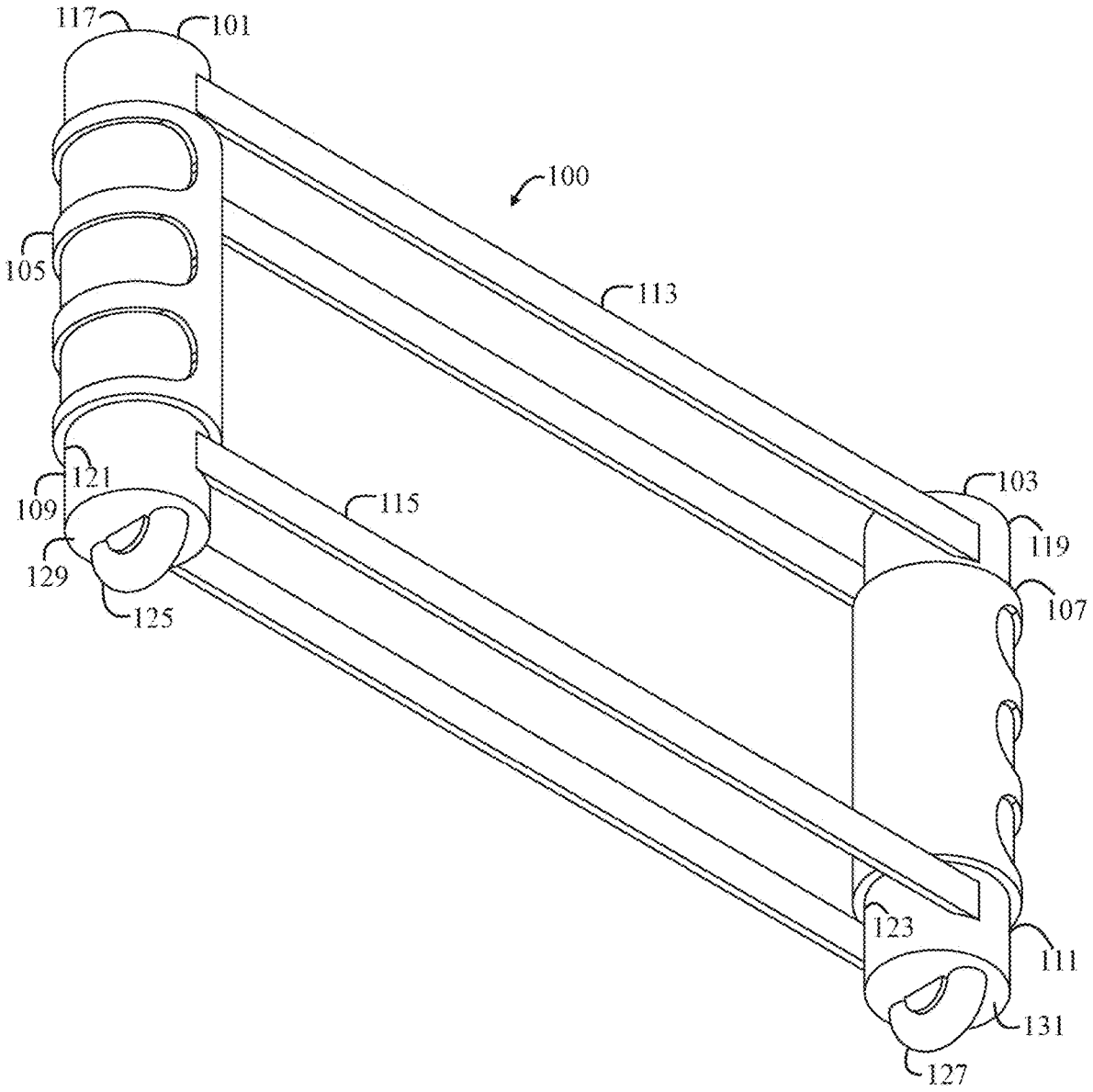
FIG. 2 illustrates a perspective view of the exercise device, according to some embodiments.

FIG. 1 and FIG. 2 illustrate the exercise device 100. The exercise device includes a first handle assembly 101 and a second handle assembly 103 (which may be referred to collectively as "handle assembly" or "the handle assembly". Each handle assembly includes a handle 105,107 and which are grasped by the user during the exercise movement. Cylinders 109,111 are positioned within the interior diameter of the handles 105,107 and are retained therein to provide a means for connecting a first elastic band 113 and a second elastic band 115. The first elastic band 113 is connected to each handle assembly 101,103 at a top portions 117,119 of the first handle assembly 101 and the second handle assembly 103 respectively and the second elastic band 115 is positioned at the bottom portions 121,123 of the first handle assembly 101 and second handle assembly 103 respectively. First and second wheels 125,127 are provided at the bottoms 129,131 of the first handle assembly 101, and the second handle assembly 103.

Each handle assembly can be used by the left or right hands or feet of the user. While settings of the handle assemblies may be modified, each handle assembly is not designated to a specific hand or foot.

In some embodiments, the cylinders 109,111 are retained through the interior of the handles 105,107 via a friction fit, an adhesive, mechanical connection, or the cylinders 109, 111 and handles 105,107 may be integrally molded to one another.

Figure 3:
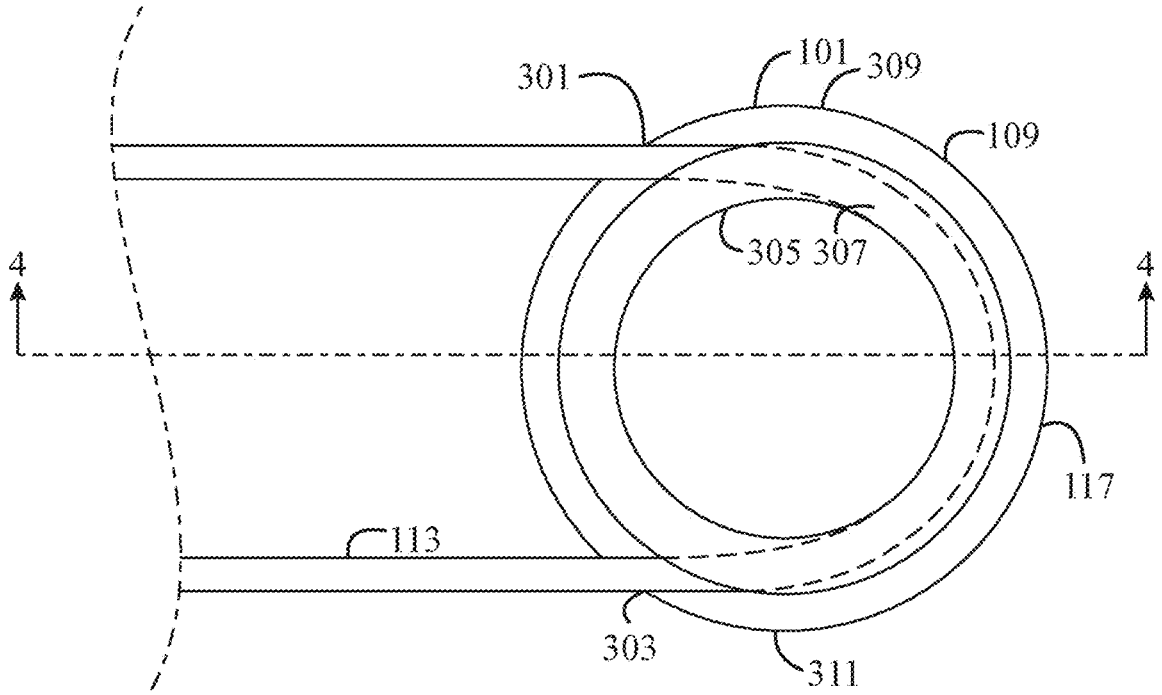
FIG. 3 illustrates a detail view of the handle and elastic band, according to some embodiments.

FIG. 3 illustrates a detail view of the first handle assembly 101 and elastic band 113 connected thereto. The top portion 117 of the first handle assembly 101 is illustrated by way of example to avoid being unduly repetition in describing the top and bottom portions of each handle assembly. It is to be understood that the connections of the elastic bands at each of the top and bottom portions of the first and second handle assemblies accomplished in the same way. Each handle assembly includes openings 301,303 provided on the cylinder 109 allowing the elastic band 113 to be connected thereto. The cylinder 109 contains an inner cylinder 305 which accepts the elastic band 113 through an interior space 307, retaining the elastic band 113 in a suitable position during exercise as the elastic expands and contracts. Having the elastic band 113 extend from the first and second openings 301, 303 provides a balanced and even resistance between the first side 309,311 of each handle assembly during exercise.

While the exemplary drawing FIG. 3 illustrates the top portion 117 of the first handle assembly 101 having the first elastic band 113 connected thereto, one skilled in the arts will readily understand that the depiction can be the top portion 119 of the second handle assembly 103 which is also connected to the first elastic band 113 or may depict either of the bottom portion of the first handle assembly 101 or second handle assembly 103 which connect to the second elastic band 115. Openings are positioned on each of these elements in a similar manner to connect the rubber bands to the handle assemblies 101,103.

Figure 4:
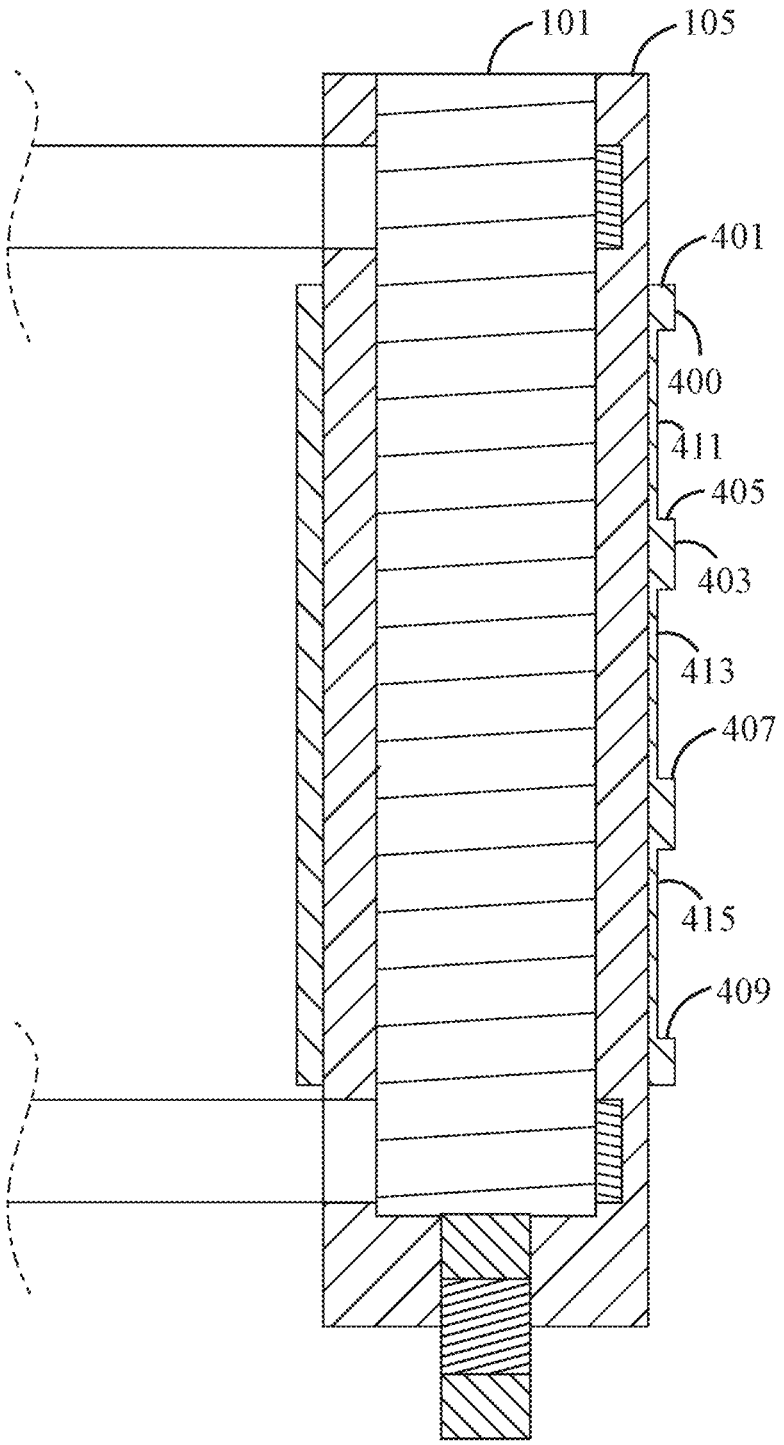
FIG. 4 illustrates a detail view of the handle assembly, according to some embodiments.

FIG. 4 illustrates a detail view of the first handle assembly 101 (the first handle assembly 101 being shown by way of example, however, the second handle assembly would be configured in the same manner). The handle assembly includes the handle 105 which has a grip 400. The grip includes ridges 401 which provide a means for increasing friction between the hands and handle assembly 101. This is beneficial during exercise as the resistance imparted by the elastic bands can rip the handle from the users grasp without a proper grip. In some embodiments, the handles may be constructed of rubber, plastic, or other material which can provide a comfortable and ergonomic interface between the handle and hands of the user. An abrasive may be applied to the surface 403 of the handle 400 to provide a more secure surface for the user to grasp. The grip 400 includes a plurality of ridges (including 401,405,407,409) having recessed portions 411,413,415 therebetween to provide a space for the fingers to fit between each ridge 401,405,407, 409 and prevent slippage of the hand and/or fingers.

Figure 5:
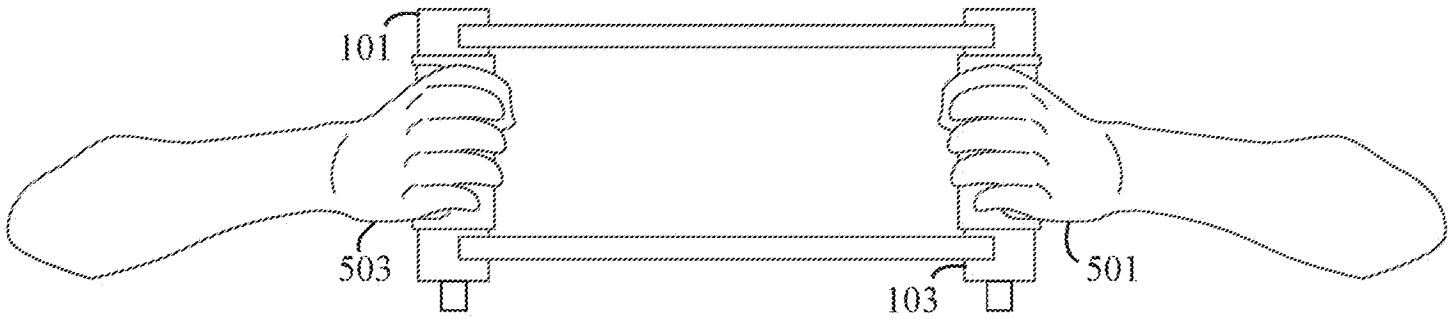
FIG. 5 illustrates a schematic of the exercise device in-use and in a retracted configuration, wherein the user is holding each handle with their hands, according to some embodiments.
Figure 6:
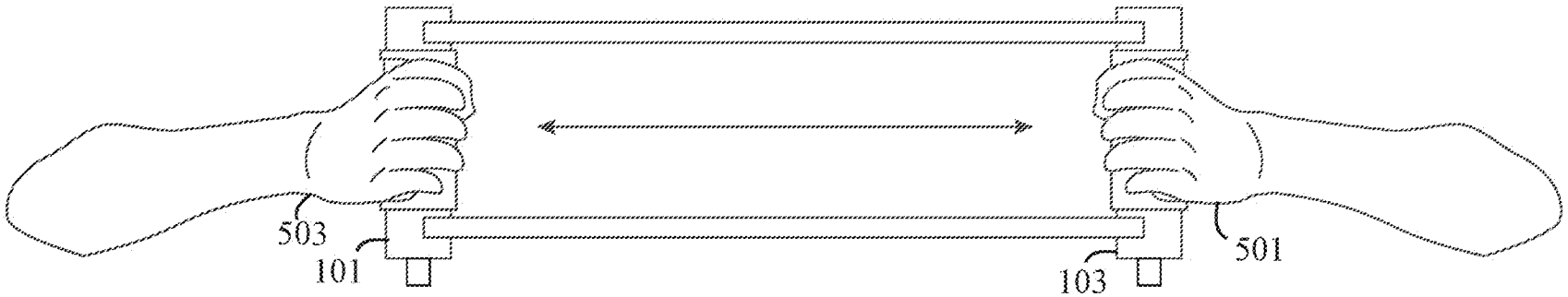
FIG. 6 illustrates a schematic of the exercise device in-use and in an expanded configuration, wherein the user is holding and separating each handle, according to some embodiments.
Figure 7:
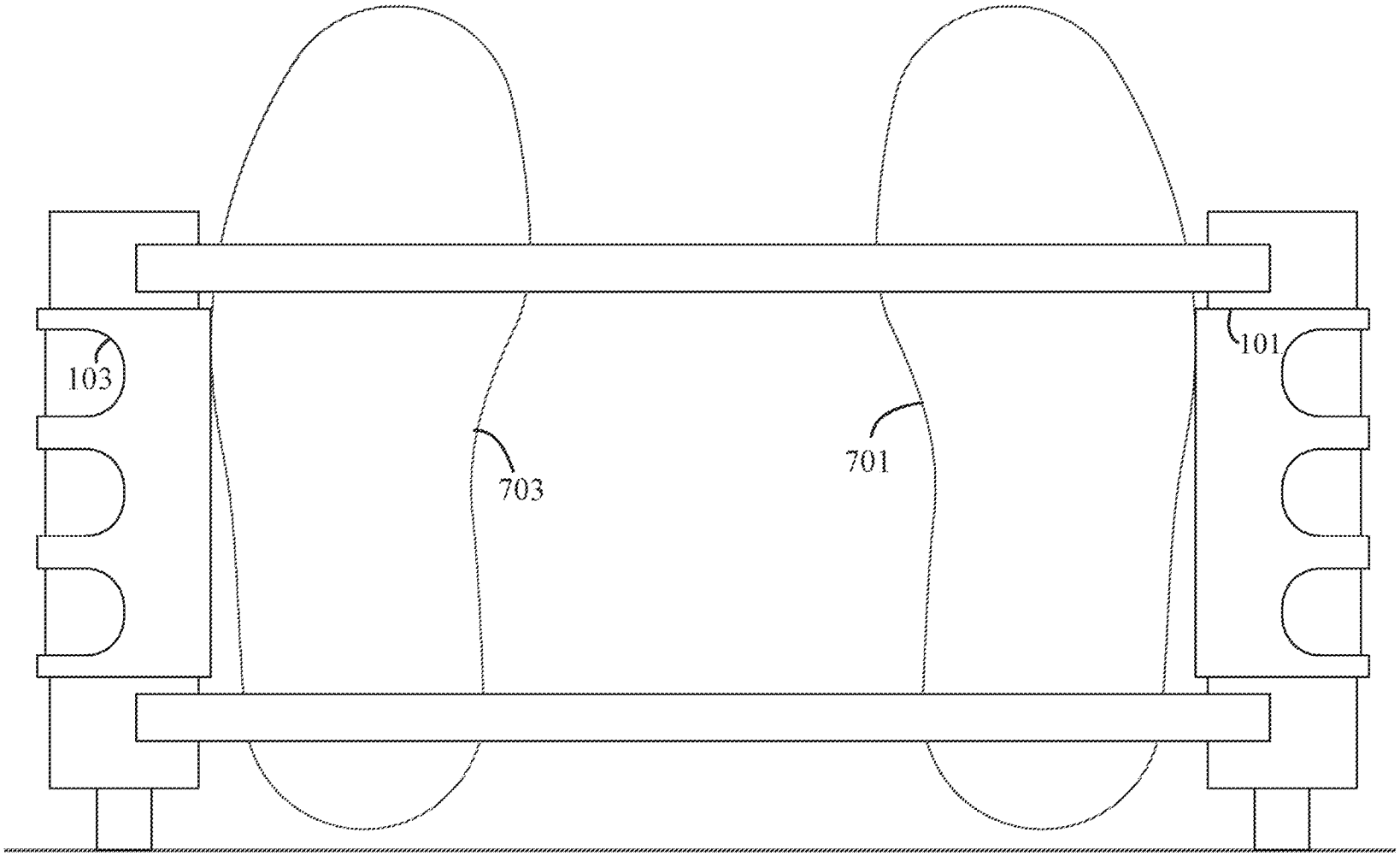
FIG. 7 illustrates a schematic of the exercise device in-use, wherein the user is utilizing their feed to separate the handles, according to some embodiments.

FIG. 5 and FIG. 6 illustrate a schematic of the exercise device in-use and in a retracted configuration (see FIG. 5) and expanded configuration (see FIG. 6), wherein the user is holding each handle assembly 101,103 with their left and right hands 501,503. The user may separate each handle assemble 101,103 FIG. 7 illustrates a schematic of the exercise device in-use, wherein the user is utilizing their feet 701,703 to separate the handle assemblies 101,103. One skilled in the arts will readily understand that a variety of different exercised may be performed using the exercise device.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety to the extent allowed by applicable law and regulations. The systems and methods described herein may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The foregoing is provided for purposes of illustrating, explaining, and describing embodiments of this disclosure. Modifications and adaptations to these embodiments will be apparent to those skilled in the art and may be made without departing from the scope or spirit of this disclosure.

As used herein and in the appended claims, the singular forms "a", "an", and "the" include plural referents unless the context clearly dictates otherwise.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic intervening entities) and the indirect coupling of two entities (with one or more non-negligible intervening entities). Where entities are shown as being directly coupled together or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described herein. A variety of modifications and variations are possible in light of the above teachings without departing from the following claims.

What is claimed is:

1. An exercise device, comprising:

a first handle assembly and a second handle assembly, the first handle assembly including a first handle and the second handle assembly including a second handle;

a first cylinder retained within an inner diameter of the first handle and a second cylinder retained within an inner diameter of the second cylinder;

a first elastic band attached to top portions of the first cylinder and the second cylinder, respectively;

a second elastic band attached to bottom portions of the first cylinder and the second cylinder, respectively;

a first wheel and a second wheel respectively positioned on a bottom of a longitudinal axis of each of the first cylinder and the second cylinder, wherein each of the first and second elastic bands provides resistance when spreading the first handle assembly and the second handle assembly apart.

2. The exercise device of claim 1, wherein the first handle and the second handle each includes a grip.

3. The exercise device of claim 2, wherein each grip includes a plurality of ridges to aid in grasping the grip.

4. The exercise device of claim 3, wherein each ridge is separated by a recessed portion configured to accept fingers of a user.

5. The exercise device of claim 4, wherein each of the first and second elastic bands enters of each the first and second cylinders through a first opening and a second opening respectively provided on each of the top portion and the bottom portion of the first and second cylinders.

6. The exercise device of claim 5, wherein the grip is constructed of rubber.

7. The exercise device of claim 5, wherein the grip is constructed of plastic.

8. The exercise device of claim 7, wherein the grip is coated with an abrasive coating.

9. An exercise device, comprising:

a first handle assembly and a second handle assembly, the first handle assembly including a first handle and the second handle assembly including a second handle;

a first cylinder retained within an inner diameter of the first handle and a second cylinder retained within an inner diameter of the second cylinder;

a first elastic band attached to top portions of the first cylinder and the second cylinder, respectively;

a second elastic band attached to bottom portions of the first cylinder and the second cylinder, respectively, each of the first and second elastic bands enters each of the first and second cylinders through a first opening and a second opening respectively provided on each of the top portion and the bottom portion of the first and second cylinders;

a first wheel and a second wheel respectively positioned on a bottom of a longitudinal axis of each of the first cylinder and the second cylinder to permit an ability to roll on a surface, wherein each of the first and second elastic bands provides resistance when spreading the first handle assembly and the second handle assembly apart.

10. The exercise device of claim 9, wherein the first handle and the second handle each includes a grip.

11. The exercise device of claim 10, wherein each grip includes a plurality of ridges to aid in grasping the grip.

12. The exercise device of claim 11, wherein each ridge is separated by a recessed portion configured to accept fingers of a user.

13. The exercise device of claim 12, wherein the first and second handle assemblies are configured to enable the user to utilize feet of the user to separate the first and second handle assemblies.

14. The exercise device of claim 13, wherein the first and second elastic bands are removable and replaceable to allow the user to change the resistance of an exercise.

15. The exercise device of claim 14, further comprising an inner cylinder positioned within each of the first cylinder and the second cylinder to respectively retain each of the first and the second elastic bands in position.

16. The exercise device of claim 15, wherein the grip is constructed of rubber.

17. The exercise device of claim 15, wherein the grip is constructed of plastic.

18. The exercise device of claim 17, wherein the grip is coated with an abrasive coating.

* * * * *